US010908553B1

(12) United States Patent
Watanabe et al.

(10) Patent No.: US 10,908,553 B1
(45) Date of Patent: Feb. 2, 2021

(54) CLEANING DEVICE AND IMAGE FORMING APPARATUS

(71) Applicant: FUJI XEROX CO., LTD., Tokyo (JP)

(72) Inventors: Kanji Watanabe, Kanagawa (JP); Naoya Mitamura, Kanagawa (JP)

(73) Assignee: FUJI XEROX CO.. LTD., Tokyo (JP)

( * ) Notice: Subject to any disclaimer, the term of this patent is extended or adjusted under 35 U.S.C. 154(b) by 0 days.

(21) Appl. No.: 16/743,705

(22) Filed: Jan. 15, 2020

(30) Foreign Application Priority Data

Sep. 11, 2019 (JP) ..... 2019-165264

(51) Int. Cl.
*G03G 21/00* (2006.01)

(52) U.S. Cl.
CPC ..... *G03G 21/0011* (2013.01); *G03G 21/0029* (2013.01)

(58) Field of Classification Search
CPC ..... G03G 21/0011; G03G 21/0029
See application file for complete search history.

(56) References Cited

U.S. PATENT DOCUMENTS 4,334,766 A * 6/1982 Sugiyama ..... G03G 21/0029 15/256.51
4,498,760 A * 2/1985 Sugiyama ..... G03G 21/0029 15/256.51
2007/0086815 A1* 4/2007 Koiso ..... G03G 21/0029 399/350
2008/0240812 A1* 10/2008 Yamashita ..... G03G 21/0029 399/351
2009/0263154 A1 10/2009 Izumi et al.
2010/0067949 A1* 3/2010 Watanabe ..... G03G 21/0029 399/123
2013/0216287 A1* 8/2013 Inami ..... G03G 21/0029 399/351
2017/0031310 A1* 2/2017 Kichise ..... G03G 21/0029

FOREIGN PATENT DOCUMENTS

JP 58149085 A * 9/1983 ..... G03G 21/0029
JP 60-012569 A 1/1985
JP 2008-176175 A 7/2008
JP 2009-258483 A 11/2009

* cited by examiner

*Primary Examiner* — Sophia S Chen
(74) *Attorney, Agent, or Firm* — Sughrue Mion, PLLC

(57) ABSTRACT

A cleaning device includes a cleaning unit that cleans an object to be cleaned that moves by bringing a contact portion into contact with the object to be cleaned, the contact portion extending in a width direction that crosses a moving direction in which the object to be cleaned moves, the cleaning unit including a supported surface at a downstream side in the moving direction; and a support unit including a supporting surface that faces the supported surface and that includes a bonded portion bonded to the supported surface, the support unit supporting the cleaning unit at the bonded portion. The bonded portion is provided at an intermediate position of the supporting surface in a direction in which the supporting surface extends toward the object to be cleaned, and the support unit includes an extending portion that extends further toward the object to be cleaned from the bonded portion.

14 Claims, 9 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2019-165264 filed Sep. 11, 2019.

BACKGROUND

(i) Technical Field

The present disclosure relates to a cleaning device and an image forming apparatus.

(ii) Related Art

Image forming apparatuses that form a toner image, transfer the toner image onto a paper sheet, and fix the toner image to the paper sheet are widely known. This type of image forming apparatus generally includes a plate-shaped cleaning member called a cleaning blade made of a hard rubber material. The cleaning blade is pressed against an image carrier, which carries the toner image until the toner image is transferred, or an intermediate transfer belt, to which the toner image is transferred from the image carrier and which carries the toner image until the toner image is transferred onto the paper sheet, to remove, for example, residual toner that remains after the transfer process.

The cleaning blade is pressed against an object to be cleaned, such as a photoconductor or an intermediate transfer body, while the object to be cleaned moves. Therefore, the cleaning blade receives a large stress due to friction, and there is a risk that plastic deformation called curling of the cleaning blade will occur. The curling is desirably reduced.

Japanese Unexamined Patent Application Publication No. 2008-176175 discloses a structure in which a cleaning blade is provided with metal plates at both ends thereof in a width direction to prevent curling of the cleaning blade.

Japanese Unexamined Patent Application Publication No. 2009-258483 discloses a structure in which a cleaning blade is supported by a back metal plate that spreads toward an object to be cleaned at both ends of the cleaning blade in a width direction.

Japanese Unexamined Patent Application Publication No. S60-012569 discloses a structure in which a cleaning blade is provided with a metal plate at a side at which the cleaning blade is curled, and in which an adhesive is additionally provided to prevent separation between the cleaning blade and the metal plate.

SUMMARY

Curling of a cleaning unit, such as a cleaning blade, can be effectively reduced by placing a support unit on a surface of the cleaning blade at a side at which the cleaning blade is curled, that is, on a surface of the cleaning blade facing downstream in a direction in which an object to be cleaned moves. The support unit is configured to extend to a position as close to the object to be cleaned as possible, and a portion of the support unit that is as close to the object to be cleaned as possible is fixed to the cleaning unit. However, to enable the cleaning unit to sufficiently clean the object to be cleaned, the cleaning unit needs to be appropriately flexible.

This means that only a portion of the support unit that is appropriately separated from the object to be cleaned can be fixed to the cleaning unit.

Aspects of non-limiting embodiments of the present disclosure relate to a cleaning device that includes a cleaning unit that is appropriately flexible and in which curling of the cleaning unit is reduced, and an image forming apparatus including the cleaning device.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a cleaning device including a cleaning unit that cleans an object to be cleaned that moves by bringing a contact portion into contact with the object to be cleaned, the contact portion extending in a width direction that crosses a moving direction in which the object to be cleaned moves, the cleaning unit including a supported surface at a downstream side in the moving direction; and a support unit including a supporting surface that faces the supported surface and that includes a bonded portion bonded to the supported surface, the support unit supporting the cleaning unit at the bonded portion. The bonded portion is provided at an intermediate position of the supporting surface in a direction in which the supporting surface extends toward the object to be cleaned, and the support unit includes an extending portion that extends further toward the object to be cleaned from the bonded portion.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will now be described.

Figure 1:
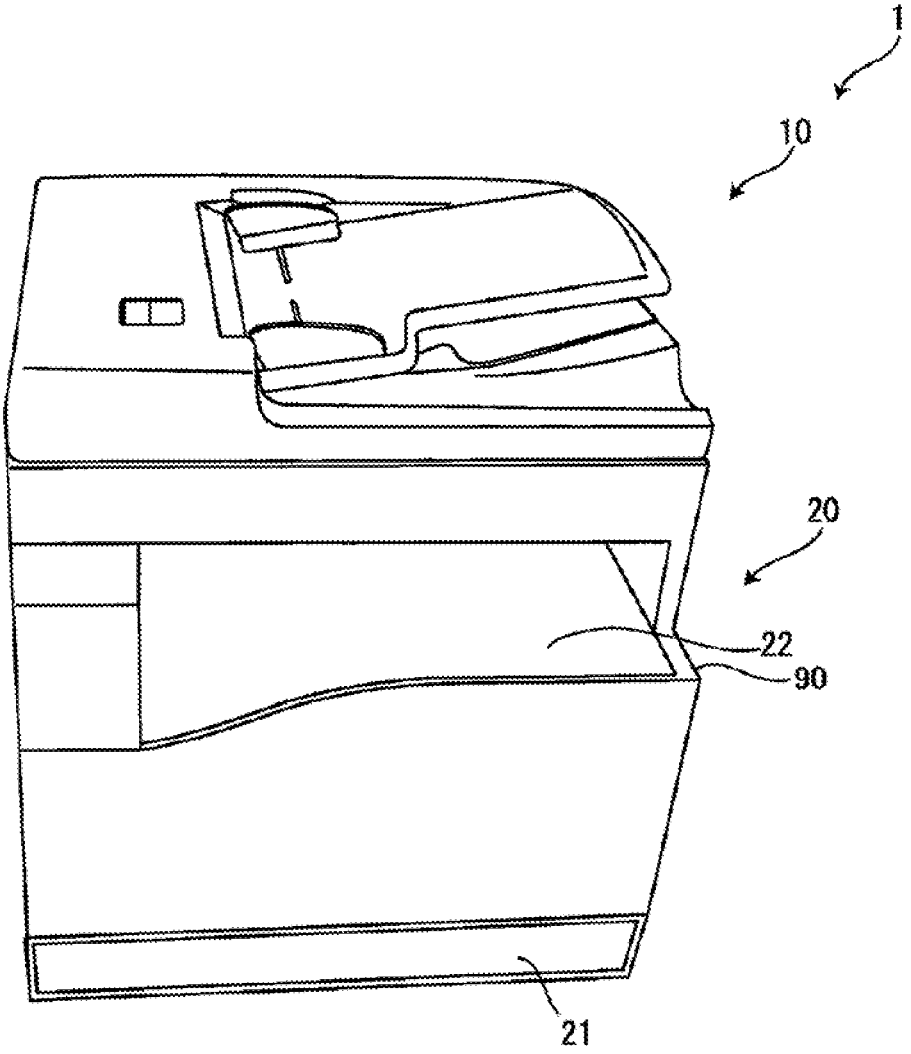
FIG. 1 is an external perspective view of an image forming apparatus according to an exemplary embodiment of the present disclosure.

FIG. 1 is an external perspective view of an image forming apparatus according to an exemplary embodiment of the present disclosure.

The image forming apparatus 1 includes a scanner 10 and a printer 20.

The scanner 10 is placed on an apparatus housing 90, which is a framework of the image forming apparatus 1, and the printer 20 is disposed in the apparatus housing 90.

Figure 2:
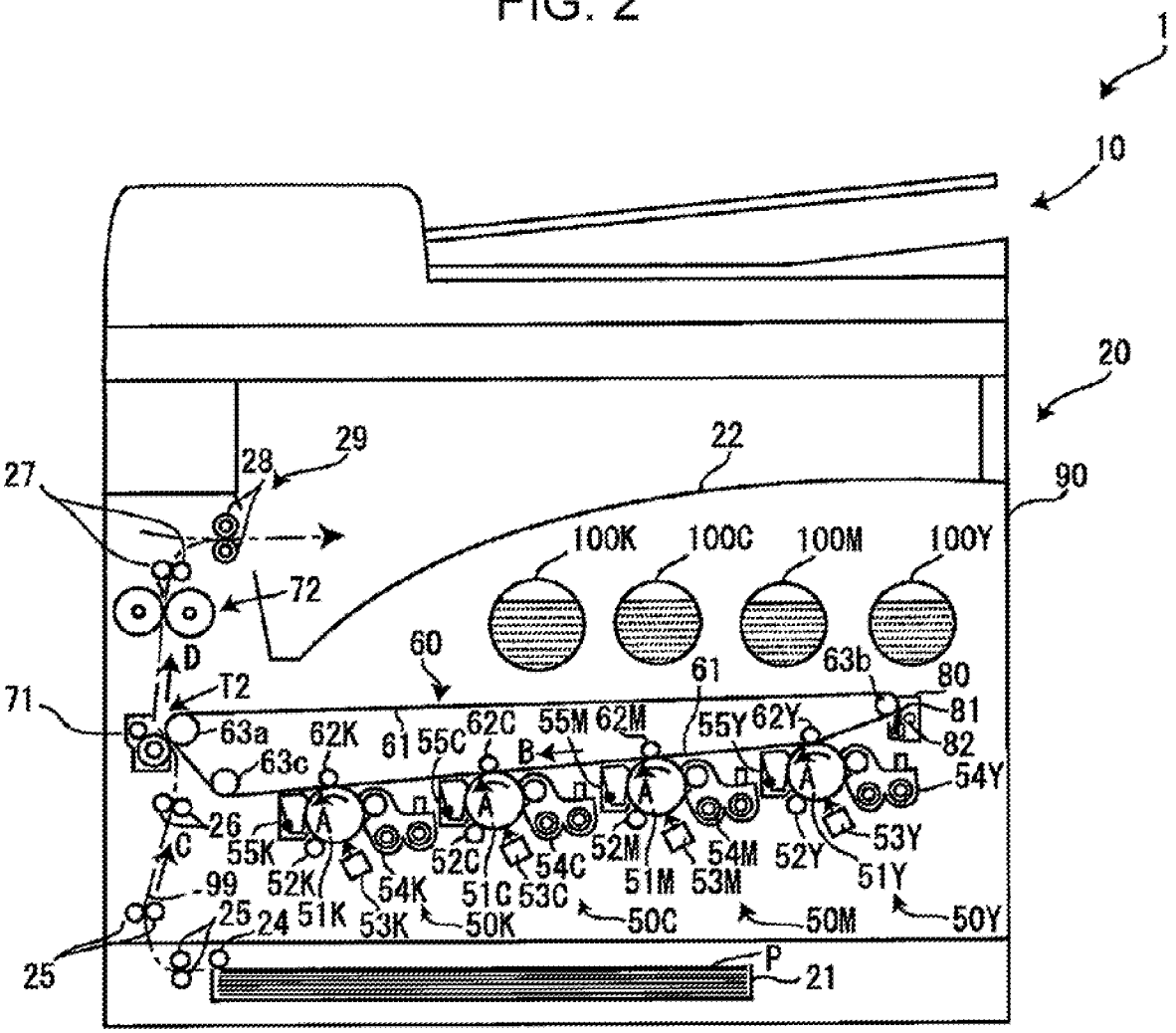
FIG. 2 is a schematic diagram illustrating the internal structure of the image forming apparatus whose external appearance is illustrated in FIG. 1.

FIG. 2 is a schematic diagram illustrating the internal structure of the image forming apparatus whose external appearance is illustrated in FIG. 1.

The printer 20 includes four image forming units 50Y, 50M, 50C, and 50K, which are substantially horizontally arranged in one line. The image forming units 50Y, 50M, 50C, and 50K form toner images of respective colors, which are yellow (Y), magenta (M), cyan (C), and black (K). In this specification, when common features of the image forming units 50Y, 50M, 50C, and 50K are described, the image forming units are referred to as image forming units 50 without attaching the symbols Y, M, C, and K for distinguishing the colors of the toners. This also applies to components other than the image forming units.

Each image forming unit 50 includes an image carrier 51. An electrostatic latent image is formed on a surface of the image carrier 51 and developed into a toner image while the image carrier 51 receives a driving force and rotates in the direction shown by arrow A.

A charging device 52, an exposure device 53, a developing device 54, a first transfer device 62, and a cleaner 55 are arranged around the image carrier 51 included in each image forming unit 50. The first transfer device 62 is located such that an intermediate transfer belt 61, which will be described below, is interposed between the first transfer device 62 and the image carrier 51. The first transfer device 62 is not a component of the image forming unit 50, but is a component of an intermediate transfer unit 60, which will be described below.

The charging device 52 uniformly charges the surface of the image carrier 51.

The exposure device 53 forms an electrostatic latent image on the image carrier 51 by irradiating the uniformly charged surface of the image carrier 51 with exposure light that is modulated on the basis of an image signal.

The developing unit 54 contains developer including carrier and toner of the color corresponding to the image forming unit 50. The developing device 54 develops the electrostatic latent image on the image carrier 51 with toner of the color corresponding to the image forming unit 50, thereby forming a toner image on the image carrier 51.

The first transfer device 62 transfers the toner image temporarily carried by the image carrier 51 onto the intermediate transfer belt 61, which will be described below.

The cleaner 55 removes from the image carrier 51 residual toner, for example, that remains on the image carrier 51 after the transferring process.

The intermediate transfer unit 60 is disposed above the four image forming units 50. The intermediate transfer unit 60 includes the intermediate transfer belt 61. The intermediate transfer belt 61 is supported by plural rollers including a drive roller 63*a*, a driven roller 63*b*, and a stretching roller 63*c*. The intermediate transfer belt 61 is driven by the drive roller 63*a* and circulates in the direction shown by arrow B along a circulating path including paths on the four photoconductors 51 of the respective image forming units 50.

The toner images on the photoconductors 51 are successively transferred onto the intermediate transfer belt 61 in a superposed manner by operations of the respective first transfer devices 62. The toner images that have been transferred onto the intermediate transfer belt 61 are transported to a second transfer position T2 by the intermediate transfer belt 61. A second transfer device 71 is disposed at the second transfer position T2, and the toner images on the intermediate transfer belt 61 are transferred onto a paper sheet P, which has been transported to the second transfer position T2, by an operation of the second transfer device 71. Transportation of the paper sheet P will be described below. The toner, for example, that remains on the intermediate transfer belt 61 after the toner images have been transferred onto the paper sheet P is removed from the intermediate transfer belt 61 by a cleaner 80.

The cleaner 80 includes a cleaning blade 81 and an auger 82. The cleaning blade 81 has a distal edge 811 (see FIG. 3) that is pressed against the intermediate transfer belt 61, and serves as a member for scraping off, for example, the residual toner on the intermediate transfer belt 61. The cleaning blade 81 corresponds to an example of a cleaning unit according to the present disclosure. The auger 82 extends in a direction perpendicular to the plane of FIG. 2, and conveys, for example, the residual toner that has been scraped off in this direction. The residual toner, for example, is finally discharged into a waste toner tank (not illustrated). The cleaner 80 corresponds to an example of a cleaning device according to the present disclosure. The cleaner 80 will be described in detail below.

Toner cartridges 100 containing toners of the respective colors are disposed above the intermediate transfer unit 60. When the toners contained in the developing devices 54 are consumed in the developing process, the toners of the corresponding colors are supplied to the developing devices 54 through toner supply channels (not shown) from the toner cartridges 100 containing the toners. The toner cartridges 100 are detachably attached to the apparatus housing 90. When the toner cartridges 100 become empty, they are removed and replaced with new toner cartridges 100.

A paper sheet P is fed from a paper tray 21 by a pick-up roller 24, and is transported to timing adjustment rollers 26 by transport rollers 25 along a transport path 99 in the direction shown by arrow C. The paper sheet P that has been transported to the timing adjustment rollers 26 is transported by the timing adjustment rollers 26 toward the second transfer position T2 so that the paper sheet P reaches the second transfer position T2 at the time when the toner images on the intermediate transfer belt 61 reach the second transfer position T2. The paper sheet P transported by the timing adjustment rollers 26 receives the toner images from the intermediate transfer belt 61 at the second transfer position T2 as a result of the operation of the second transfer device 71. The paper sheet P to which the toner images have been transferred is further transported in the direction shown by arrow D toward a fixing device 72 disposed above the second transfer device 71 while being guided by a paper sheet guide.

The toner images on the paper sheet P that has been transferred in the direction of arrow D and reached the fixing device 72 are fixed to the paper sheet P by being heated and pressurized by the fixing device 72. Thus, an image formed of the fixed toner images is printed on the paper sheet P. The paper sheet P, to which the toner images are fixed by the fixing device 72, is further transported by transport rollers 27 and is discharged to a paper output tray 22 through a paper output slot 29 by paper output rollers 28.

Figure 3:
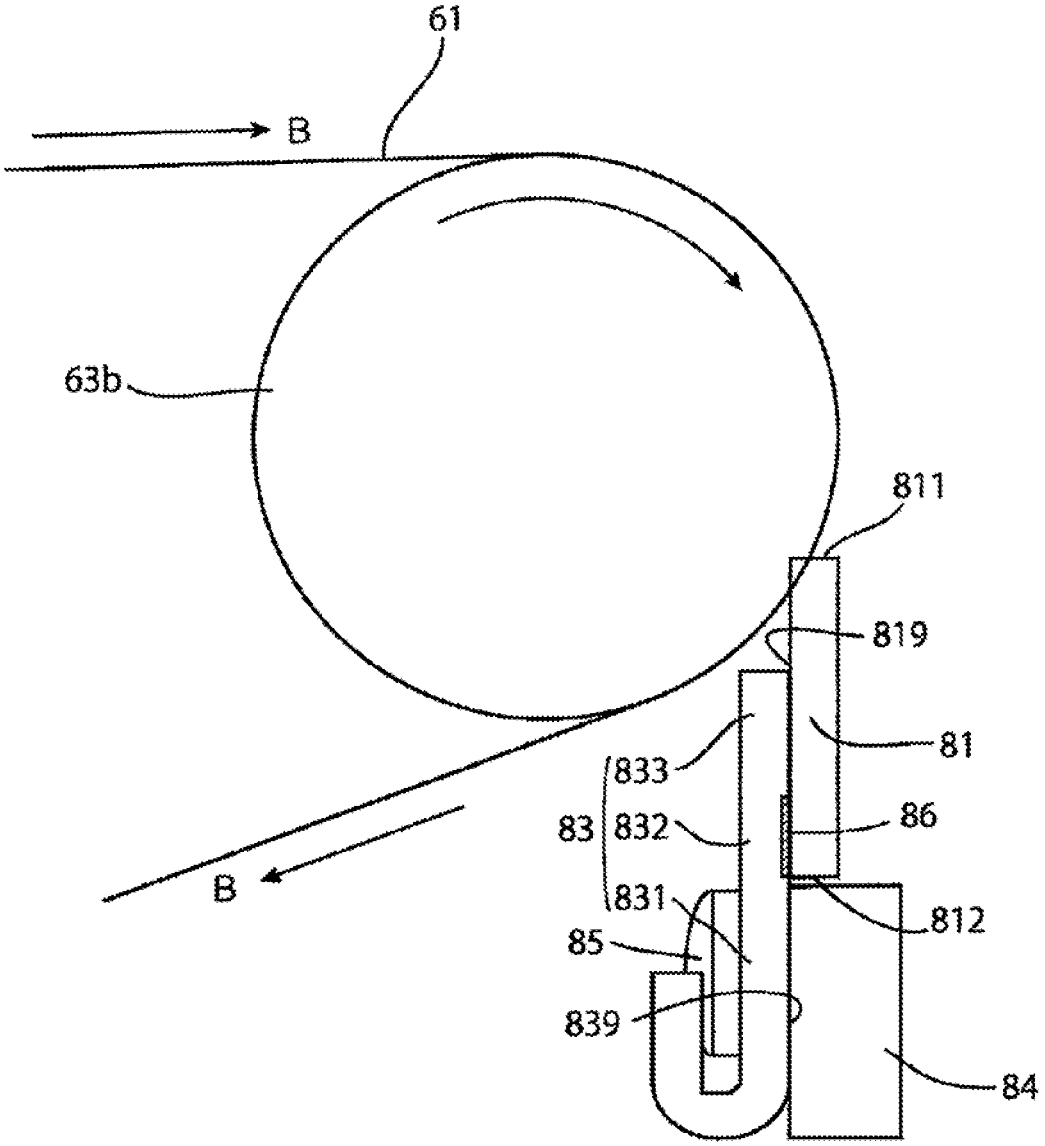
FIG. 3 is a schematic diagram illustrating a characterizing part of a cleaner according to a first exemplary embodiment of the present disclosure.

FIG. 3 is a schematic diagram illustrating a characterizing part of the cleaner according to the first exemplary embodiment of the present disclosure.

FIG. 3 illustrates the cleaning blade 81, a support metal plate 83, a frame 84, and a screw 85. The auger 82 and the housing of the cleaner 80 are not illustrated in FIG. 3 and in each of the following drawings.

The cleaning blade 81 is bonded to the support metal plate 83 with an adhesive 86. The support metal plate 83 is fastened to the frame 84 with the screw 85.

One of the problems of the cleaning blade 81 is that the cleaning blade 81 is curled due to friction between the cleaning blade 81 and the intermediate transfer belt 61 and cleaning failure occurs in the region where the cleaning blade 81 is curled.

Accordingly, each of the exemplary embodiments including the first exemplary embodiment illustrated in FIG. 3 includes a device for reducing curling of the cleaning blade 81.

The support metal plate 83 is provided on a downstream side of the cleaning blade 81, that is, on a side toward which the cleaning blade 81 is pressed due to friction between the cleaning blade 81 and the intermediate transfer belt 61. A supported surface 819 of the cleaning blade 81 that faces downstream is attached with the adhesive 86 to a supporting surface 839 of the support metal plate 83 that faces the cleaning blade 81 only in a region near a proximal edge 812. The support metal plate 83 includes a screw-fastened portion 831 that is screw-fastened to the frame 84, a bonded portion 832 that is bonded to the cleaning blade 81 with the adhesive 86, and an extending portion 833 that extends toward the distal edge 811 of the cleaning blade 81 beyond the bonded portion 832. The support metal plate 83 corresponds to an example of a support unit according to the present disclosure.

When it is only required to prevent curling, the support metal plate 83 may be bonded to the cleaning blade 81 with the adhesive 86 over a region extending to a position as close to the distal edge 811 of the cleaning blade 81 as possible, that is, to the distal end of the extending portion 833. However, to ensure appropriate cleaning performance of the cleaning blade 81, the cleaning blade 81 is to be appropriately flexible in the region near the distal edge 811. Accordingly, in the first exemplary embodiment illustrated in FIG. 3, the support metal plate 83 includes the bonded portion 832 that is bonded only in a region near the proximal edge 812 to ensure appropriate flexibility of the cleaning blade 81. When the frictional force between the cleaning blade 81 and the intermediate transfer belt 61 is increased to such an extent that curling of the cleaning blade 81 occurs, the extending portion 833 strongly supports the cleaning blade 81 to prevent abnormal deformation of the cleaning blade 81. Thus, curling the cleaning blade 81 is reduced.

Figure 4B:
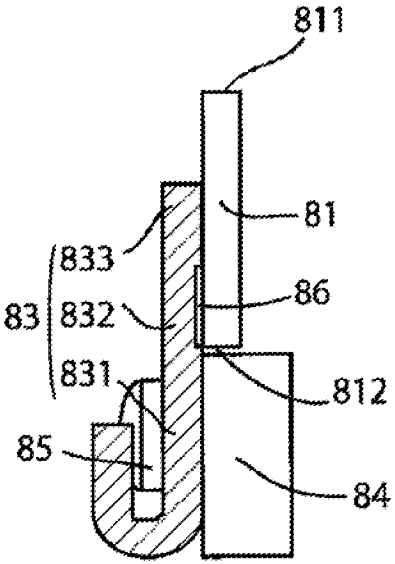
FIG. 4B illustrates the characterizing part of the cleaner illustrated in FIG. 3 viewed in the same direction as in FIG. 3.
Figure 4A:
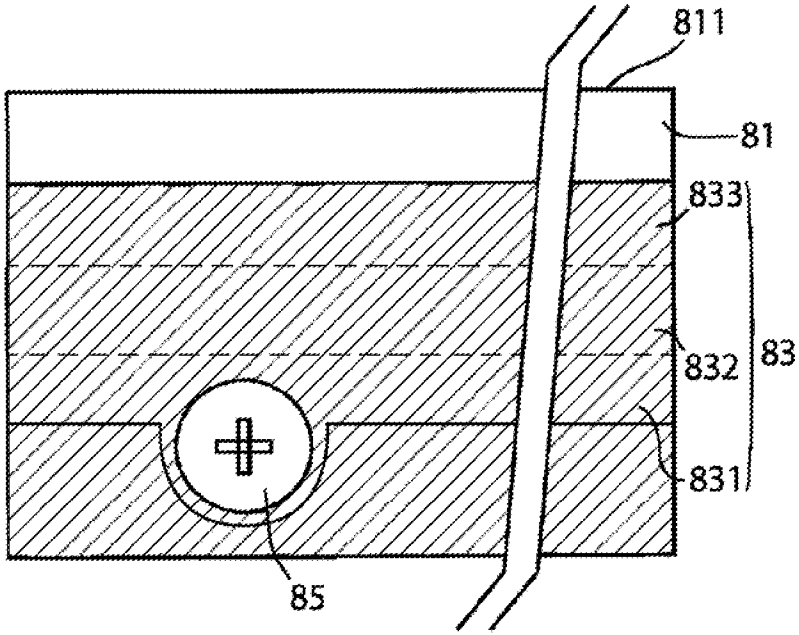
FIG. 4A illustrates the characterizing part of the cleaner illustrated in FIG. 3, viewed such that a width direction of an intermediate transfer belt (direction perpendicular to the plane of FIG. 3) is the horizontal direction.

FIG. 4A illustrates the characterizing part of the cleaner illustrated in FIG. 3, viewed such that the width direction of the intermediate transfer belt (direction perpendicular to the plane of FIG. 3) is the horizontal direction. FIG. 4B illustrates the characterizing part of the cleaner illustrated in FIG. 3 viewed in the same direction as in FIG. 3. In the figures, the support metal plate 83 is hatched to facilitate understanding.

In the example illustrated in FIGS. 4A and 4B, the bonded portion 832 and the extending portion 833 of the support metal plate 83 each have the same shape at any position in the width direction of the intermediate transfer belt (left-right direction in FIG. 4A). Therefore, in FIGS. 4A and 4B, the cleaning blade 81 has the same flexibility at any position in the width direction of the intermediate transfer belt (left-right direction in FIG. 4A).

Figure 5B:
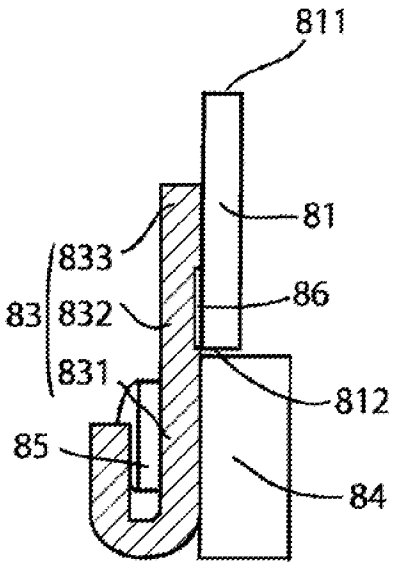
FIG. 5B illustrates the modification of the characterizing part of the cleaner illustrated in FIG. 3 viewed in the same direction as in FIG. 3.
Figure 5A:
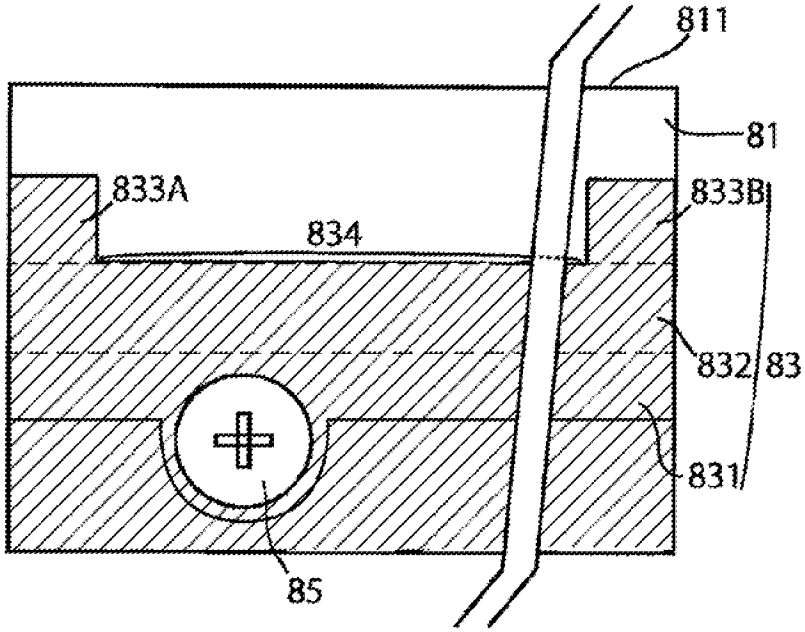
FIG. 5A illustrates a modification of the characterizing part of the cleaner illustrated in FIG. 3, viewed such that the width direction of the intermediate transfer belt (direction perpendicular to the plane of FIG. 3) is the horizontal direction.

FIG. 5A illustrates a modification of the characterizing part of the cleaner illustrated in FIG. 3, viewed such that the width direction of the intermediate transfer belt (direction perpendicular to the plane of FIG. 3) is the horizontal direction. FIG. 5B illustrates the modification of the characterizing part of the cleaner illustrated in FIG. 3 viewed in the same direction as in FIG. 3. Also in these figures, the support metal plate 83 is hatched to facilitate understanding.

In the example illustrated in FIGS. 5A and 5B, the support metal plate 83 is formed such that only end portions thereof in the width direction of the intermediate transfer belt (left-right direction in FIG. 5A) extend toward the distal edge 811 of the cleaning blade 81. In other words, extending portions 833A and 833B are formed only at both ends of the support metal plate 83. An intermediate portion 834 between the extending portions 833A and 833B does not extend beyond the bonded portion 832 to which the adhesive 86 is applied.

Curling of the cleaning blade 81 starts at one of the ends of the cleaning blade 81 in the width direction of the intermediate transfer belt (left-right direction in FIG. 5A). Accordingly, as illustrated in FIGS. 5A and 5B, the extending portions 833A and 833B may be provided only at both ends of the support metal plate 83. In this case, the cleaning blade 81 is not supported by the support metal plate 83 and is therefore more flexible in the region corresponding to the intermediate portion 834 of the support metal plate 83.

Thus, according to the present exemplary embodiment, the extending portion 833 of the support metal plate 83 may be formed over the entire region in the width direction, as illustrated in FIG. 4A. Alternatively, as illustrated in FIG. 5A, the extending portions 833A and 833B may be provided only at both ends. This also applies to each of the second and following exemplary embodiments described below.

Figure 6:
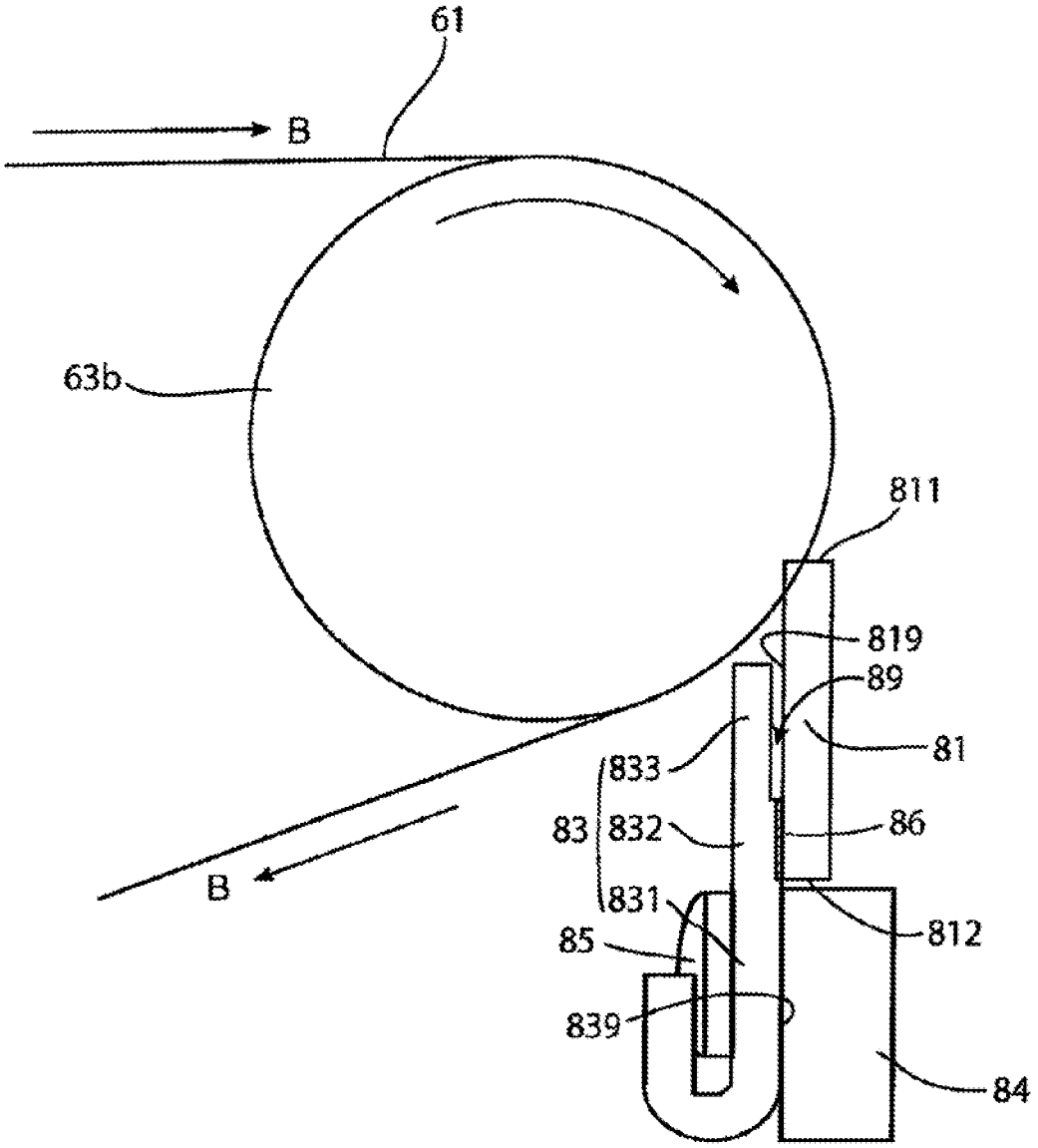
FIG. 6 is a schematic diagram illustrating a characterizing part of a cleaner according to a second exemplary embodiment of the present disclosure.

FIG. 6 is a schematic diagram illustrating a characterizing part of a cleaner according to a second exemplary embodiment of the present disclosure. In each of the second exemplary embodiment illustrated in FIG. 6 and following exemplary embodiments, components corresponding to the components according to the first exemplary embodiment illustrated in FIG. 3 are denoted by the same reference symbols as those in FIG. 3 even when the shapes, for example, thereof differ from each other.

According to the second exemplary embodiment illustrated in FIG. 6, the extending portion 833 of the support metal plate 83 has a thickness less than that of the bonded portion 832, so that a gap 89 is formed between the extending portion 833 and the cleaning blade 81. According to the first exemplary embodiment illustrated in FIG. 3, the size of the gap between the extending portion 833 of the support metal plate 83 and the cleaning blade 81 is as small as the thickness of the adhesive 86. In contrast, according to the second exemplary embodiment illustrated in FIG. 6, the thickness of the extending portion 833 is reduced so that the gap 89 is formed. Accordingly, the flexibility and cleaning performance of the cleaning blade 81 can be further increased. When the frictional force between the cleaning blade 81 and the intermediate transfer belt 61 is increased to such an extent that curling of the cleaning blade 81 occurs, the cleaning blade 81 comes into contact with the extending portion 833 and is strongly supported by the extending portion 833. Accordingly, abnormal deformation or curling of the cleaning blade 81 can be reduced.

Figure 7:
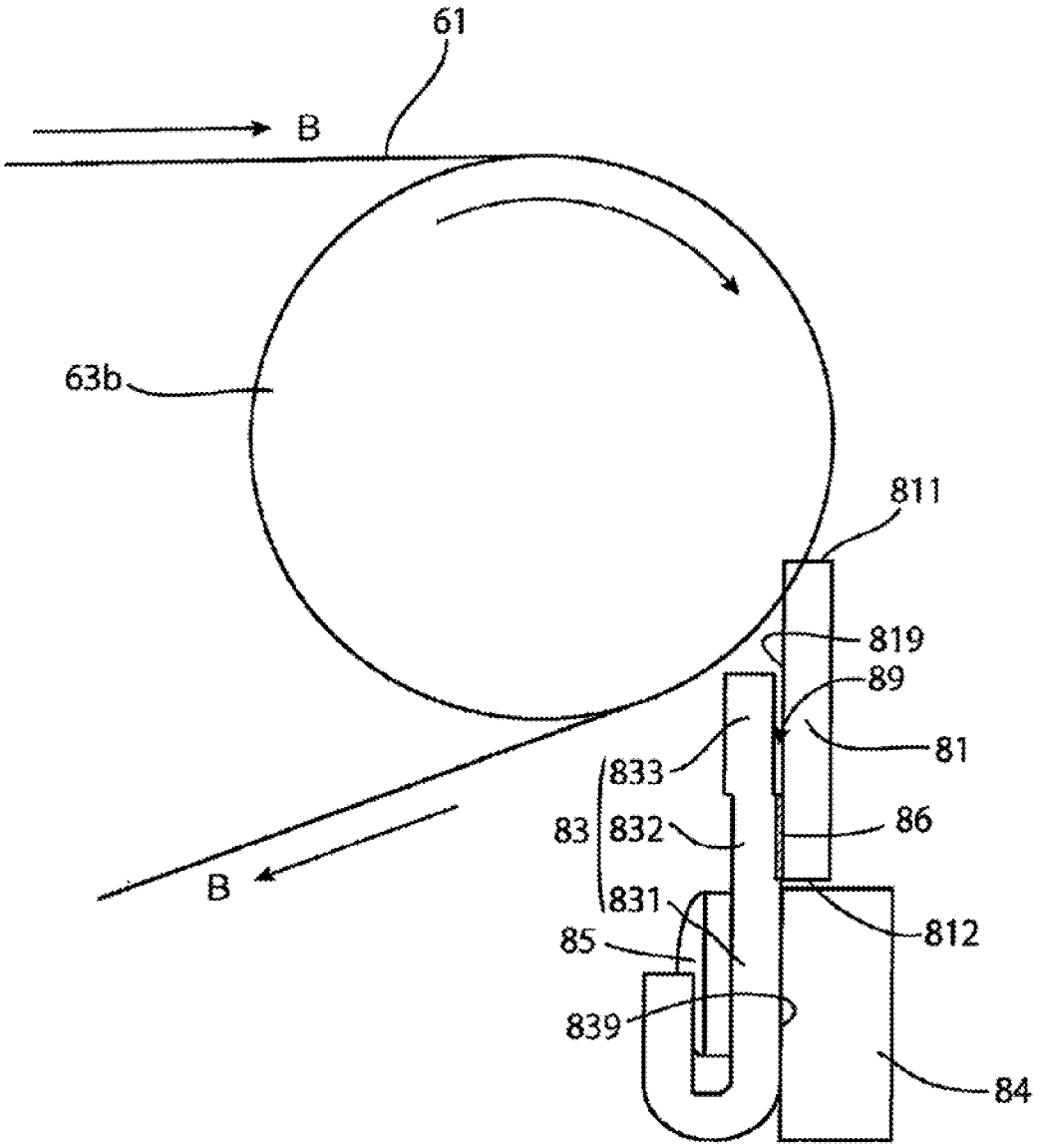
FIG. 7 is a schematic diagram illustrating a characterizing part of a cleaner according to a third exemplary embodiment of the present disclosure.

FIG. 7 is a schematic diagram illustrating a characterizing part of a cleaner according to a third exemplary embodiment of the present disclosure.

According to the third exemplary embodiment illustrated in FIG. 7, the extending portion 833 of the support metal plate 83 has the same thickness as that of the bonded portion 832, but a step is provided between the extending portion 833 and the bonded portion 832. Since the step is provided, a gap 89 is formed between the extending portion 833 and the cleaning blade 81. Also in the third exemplary embodiment illustrated in FIG. 7, similar to the second exemplary embodiment illustrated in FIG. 6, the flexibility and cleaning performance of the cleaning blade 81 can be further increased. Similar to the second exemplary embodiment, when the frictional force between the cleaning blade 81 and the intermediate transfer belt 61 is increased to such an extent that curling of the cleaning blade 81 occurs, the cleaning blade 81 comes into contact with the extending portion 833 and is strongly supported by the extending portion 833. Accordingly, abnormal deformation or curling of the cleaning blade 81 can be reduced.

Figure 8:
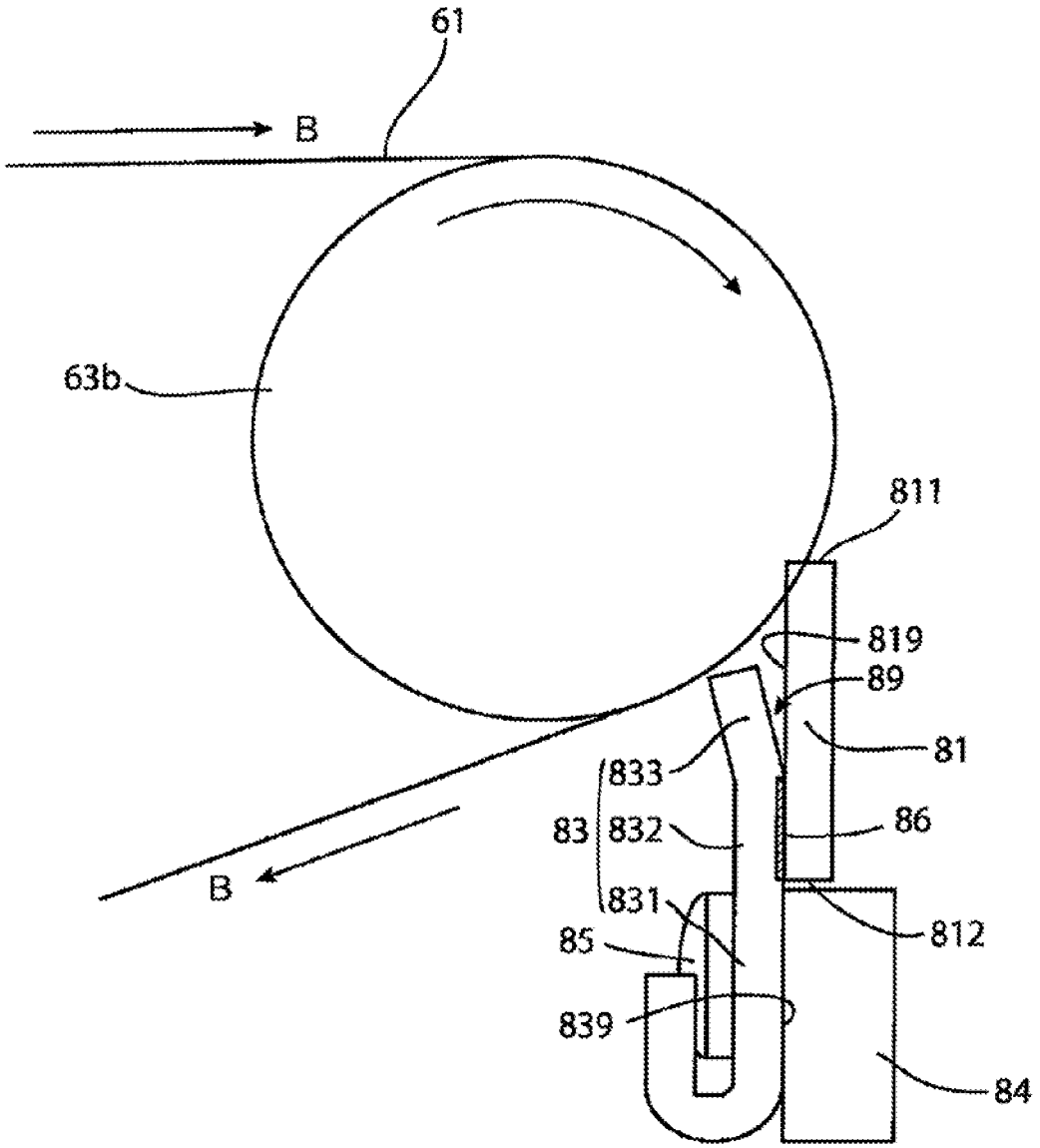
FIG. 8 is a schematic diagram illustrating a characterizing part of a cleaner according to a fourth exemplary embodiment of the present disclosure.

FIG. 8 is a schematic diagram illustrating a characterizing part of a cleaner according to a fourth exemplary embodiment of the present disclosure.

According to the fourth exemplary embodiment illustrated in FIG. 8, the extending portion 833 of the support metal plate 83 is bent so that a gap 89 is formed between the extending portion 833 and the cleaning blade 81. Also in the fourth exemplary embodiment illustrated in FIG. 8, similar to the second exemplary embodiment illustrated in FIG. 6 and the third exemplary embodiment illustrated in FIG. 7, the flexibility and cleaning performance of the cleaning blade 81 can be further increased. In addition, similar to the second and third exemplary embodiments, when the frictional force between the cleaning blade 81 and the intermediate transfer belt 61 is increased to such an extent that curling of the cleaning blade 81 occurs, the cleaning blade 81 comes into contact with the extending portion 833 and is strongly supported by the extending portion 833. Accordingly, abnormal deformation or curling of the cleaning blade 81 can be reduced.

Figure 9:
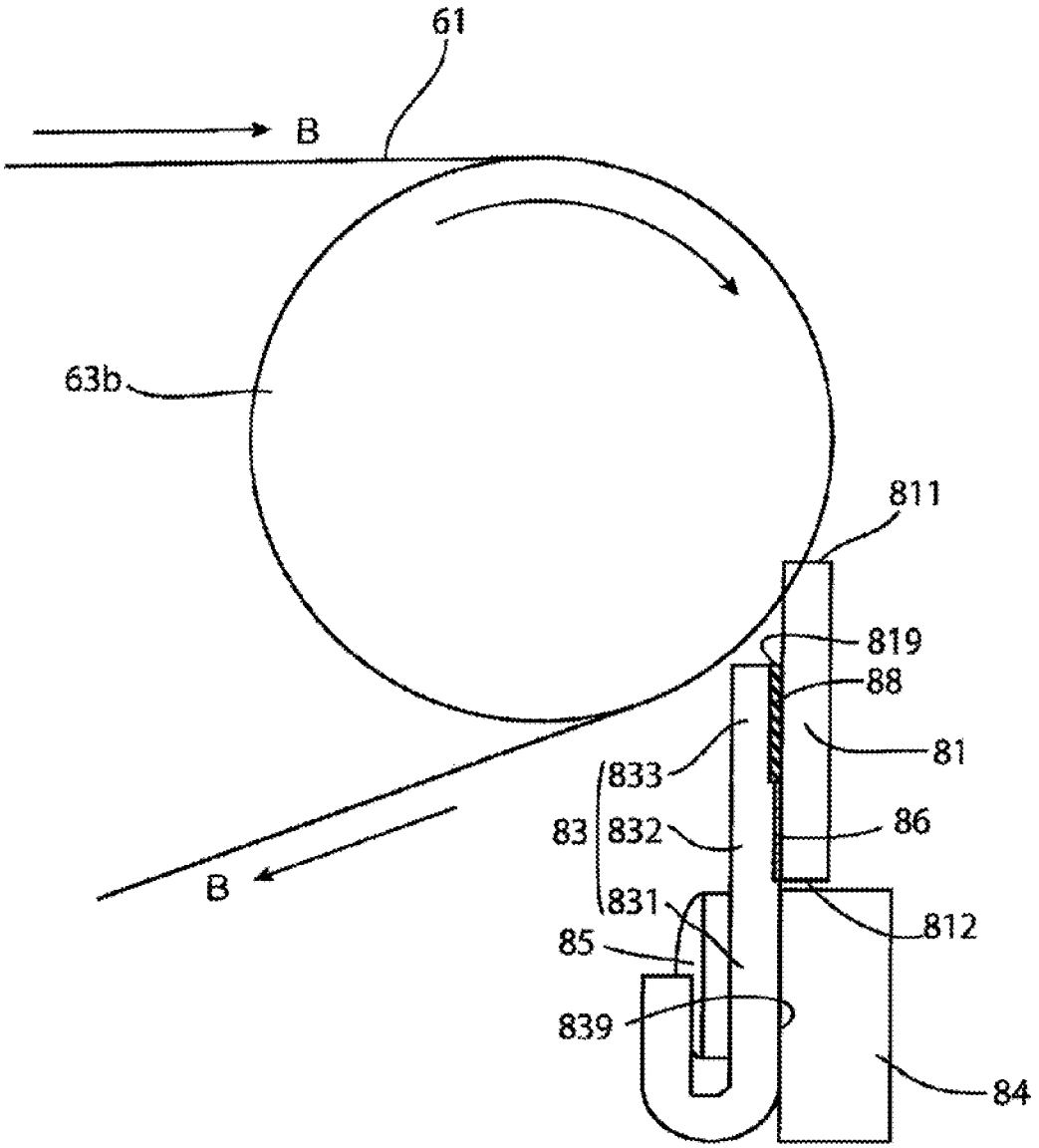
FIG. 9 is a schematic diagram illustrating a characterizing part of a cleaner according to a fifth exemplary embodiment of the present disclosure.

FIG. 9 is a schematic diagram illustrating a characterizing part of a cleaner according to a fifth exemplary embodiment of the present disclosure.

According to the fifth exemplary embodiment illustrated in FIG. 9, similar to the second exemplary embodiment illustrated in FIG. 6, the extending portion 833 of the support metal plate 83 has a thickness less than that of the bonded portion 832. The gap formed by reducing the thickness of the extending portion 833 is filled with a filler 88. The filler 88 may be, for example, a rubber-based elastic adhesive that is softer than the cleaning blade 81 and the support metal plate 83. The filler 88 corresponds to an example of a soft material according to the present disclosure. An elastic or flexible member, such as sponge or rubber, may instead be placed in the gap.

According to the fifth exemplary embodiment illustrated in FIG. 9, the cleaning blade 81 is flexible, and curling thereof is reduced. In addition, dust, such as scattered toner, can be prevented from entering the gap between the cleaning blade 81 and the support metal plate 83, accumulating in the gap, and adhering to the intermediate transfer belt 61 for some reason. Thus, images can be prevented from being stained by the dust.

Similar to the fifth exemplary embodiment illustrated in FIG. 9, also in other exemplary embodiments, the gap between the cleaning blade 81 and the support metal plate 83 may be filled.

Although the cleaner 80 for removing, for example, toner that remains on the intermediate transfer belt 61 is described herein as an example, the cleaning device according to the present disclosure may also be applied to the cleaners 55 for the image carriers 51. More generally, the cleaning device according to the present disclosure may be widely applied to cases in which an object to be cleaned that moves is cleaned by a cleaning blade.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning device comprising:

a cleaning unit configured to clean an object to be cleaned that moves by bringing a contact portion into contact with the object to be cleaned, the contact portion extending in a width direction that crosses a moving direction in which the object to be cleaned moves, the cleaning unit including a supported surface at a downstream side in the moving direction; and a support unit including a supporting surface that faces the supported surface and that includes a bonded portion bonded to the supported surface, the support unit configured to support the cleaning unit at the bonded portion, wherein the bonded portion is provided at an intermediate position of the supporting surface in a direction in which the supporting surface extends toward the object to be cleaned, wherein the support unit includes an extending portion that extends further toward the object to be cleaned from the bonded portion, and wherein the extending portion contacts a middle of the cleaning unit in a direction in which the supported surface extends toward the object to be cleaned.

2. The cleaning device according to claim 1, wherein the extending portion extends toward the object to be cleaned with a gap provided between the extending portion and the supported surface.

3. The cleaning device according to claim 2, wherein the extending portion is provided at least at each of positions corresponding to both ends of the cleaning unit in the width direction.

4. The cleaning device according to claim 2, wherein a soft material that is softer than either of the cleaning unit and the support unit is disposed between the extending portion and the supported surface.

5. The cleaning device according to claim 4, wherein the soft material is an elastic adhesive.

6. An image forming apparatus comprising:

an image carrier configured to move while carrying a toner image until the toner image is transferred; and the cleaning device according to claim 2, wherein the cleaning device is configured to clean the image carrier by coming into contact with a portion of the image carrier from which the toner image has been transferred, and wherein the image forming apparatus is configured to form an image formed of a fixed toner image on a paper sheet.

7. The cleaning device according to claim 1, wherein the extending portion is provided at least at each of positions corresponding to both ends of the cleaning unit in the width direction.

8. The cleaning device according to claim 1, wherein a soft material that is softer than either of the cleaning unit and the support unit is disposed between the extending portion and the supported surface.

9. An image forming apparatus comprising:

an image carrier configured to move while carrying a toner image until the toner image is transferred; and the cleaning device according to claim 1, wherein the cleaning device is configured to clean the image carrier by coming into contact with a portion of the image carrier from which the toner image has been transferred, and wherein the image forming apparatus is configured to form an image formed of a fixed toner image on a paper sheet.

10. A cleaning device comprising:

a cleaning unit configured to clean an object to be cleaned that moves by bringing a contact portion into contact with the object to be cleaned, the contact portion extending in a width direction that crosses a moving direction in which the object to be cleaned moves, the cleaning unit including a supported surface at a downstream side in the moving direction; and a support unit including a supporting surface that faces the supported surface and that includes a bonded portion bonded to the supported surface, the support unit configured to support the cleaning unit at the bonded portion, wherein the bonded portion is provided at an intermediate position of the supporting surface in a direction in which the supporting surface extends toward the object to be cleaned, wherein the support unit includes an extending portion that extends further toward the object to be cleaned from the bonded portion, wherein the extending portion extends toward the object to be cleaned with a gap provided between the extending portion and the supported surface, and wherein the extending portion is bent so as to extend away from the supported surface.

11. The cleaning device according to claim 10, wherein the extending portion is provided at least at each of positions corresponding to both ends of the cleaning unit in the width direction.

12. The cleaning device according to claim 10, wherein a soft material that is softer than either of the cleaning unit and the support unit is disposed between the extending portion and the supported surface.

13. The cleaning device according to claim 12, wherein the soft material is an elastic adhesive.

14. A cleaning device comprising:

a cleaning unit configured to clean an object to be cleaned that moves by bringing a contact portion into contact with the object to be cleaned, the contact portion extending in a width direction that crosses a moving direction in which the object to be cleaned moves, the cleaning unit including a supported surface at a downstream side in the moving direction; and a support unit including a supporting surface that faces the supported surface and that includes a bonded portion bonded to the supported surface, the support unit configured to support the cleaning unit at the bonded portion, wherein the bonded portion is provided at an intermediate position of the supporting surface in a direction in which the supporting surface extends toward the object to be cleaned, and wherein the support unit includes an extending portion that extends further toward the object to be cleaned from the bonded portion, wherein a soft material is disposed between the extending portion and the supported surface, and wherein the soft material is an elastic adhesive.

* * * * *